US009029061B2

(12) United States Patent
Sakata et al.

(10) Patent No.: US 9,029,061 B2
(45) Date of Patent: May 12, 2015

(54) CARRIER, DEVELOPER USING THE CARRIER, AND DEVELOPING DEVICE, IMAGE FORMING METHOD, IMAGE FORMING APPARATUS AND PROCESS CARTRIDGE USING THE DEVELOPER

(75) Inventors: Koichi Sakata, Shizuoka-ken (JP); Minoru Masuda, Shizuoka-ken (JP); Hisashi Nakajima, Shizuoka-ken (JP); Kimitoshi Yamaguchi, Shizuoka-ken (JP); Yutaka Takahashi, Kanagawa-ken (JP); Hitoshi Iwatsuki, Shizuoka-ken (JP); Saori Yamada, Shizuoka-ken (JP); Toyoaki Tano, Shizuoka-ken (JP)

(73) Assignee: Ricoh Company, Limited, Tokyo (JP)

( * ) Notice: Subject to any disclaimer, the term of this patent is extended or adjusted under 35 U.S.C. 154(b) by 610 days.

(21) Appl. No.: 12/978,920

(22) Filed: Dec. 27, 2010

(65) Prior Publication Data

US 2011/0171573 A1 Jul. 14, 2011

(30) Foreign Application Priority Data

Jan. 13, 2010 (JP) ..... 2010-005096

(51) Int. Cl.

| | |
|---|---|
| ***G03G 9/00*** | (2006.01) |
| ***G03G 9/113*** | (2006.01) |
| ***G03G 9/10*** | (2006.01) |
| *G03G 13/06* | (2006.01) |
| *G03G 13/08* | (2006.01) |

(52) U.S. Cl.

CPC ..... *G03G 9/1139* (2013.01); *G03G 13/06* (2013.01); *G03G 13/08* (2013.01); *G03G 9/10* (2013.01); *G03G 9/1136* (2013.01)

(58) Field of Classification Search

CPC ..... G03G 9/10; G03G 9/1139; G03G 9/1136; G03G 13/06; G03G 13/08

USPC ..... 430/106.1, 106.2, 111.1, 111.3, 111.31, 430/111.32, 111.33, 111.34, 1, 11.35, 111.4

See application file for complete search history.

(56) References Cited

U.S. PATENT DOCUMENTS

| | | | | |
|---|---|---|---|---|
| 7,183,034 | B2 * | 2/2007 | Kamada et al. | 430/123.5 |
| 7,192,679 | B2 | 3/2007 | Yamaguchi et al. | |
| 7,320,852 | B2 | 1/2008 | Kotsugai et al. | |
| 7,381,513 | B2 | 6/2008 | Suzuki et al. | |

(Continued)

FOREIGN PATENT DOCUMENTS

| | | |
|---|---|---|
| JP | 11-202560 | 7/1999 |
| JP | 2006-079022 | 3/2006 |

(Continued)

OTHER PUBLICATIONS

U.S. Appl. No. 12/897,326, filed Oct. 4, 2010, Takahashi, et al.

(Continued)

*Primary Examiner* — Cynthia H Kelly
*Assistant Examiner* — Omar Kekia
(74) *Attorney, Agent, or Firm* — Oblon, McClelland, Maier & Neustadt, L.L.P.

(57) ABSTRACT

A carrier for use in a two component developer for developing an electrostatic latent image is provided. The carrier includes a particulate core material; and a cover layer located on a surface of the core material and including a silicone resin and barium sulfate. The cover layer includes Ba and Si at an atomic ratio of from 0.01 to 0.08 as determined by X-ray photoelectron spectroscopy.

7 Claims, 2 Drawing Sheets

(56) References Cited

U.S. PATENT DOCUMENTS

| | | | | |
|---|---|---|---|---|
| 7,468,233 | B2 | 12/2008 | Nagayama et al. | |
| 7,527,908 | B2 | 5/2009 | Iwatsuki et al. | |
| 7,553,598 | B2 | 6/2009 | Suzuki et al. | |
| 7,592,116 | B2 | 9/2009 | Suzuki et al. | |
| 7,763,410 | B2 | 7/2010 | Yamaguchi et al. | |
| 2006/0210905 | A1 | 9/2006 | Imahashi et al. | |
| 2007/0048652 | A1 | 3/2007 | Imahashi et al. | |
| 2007/0243482 | A1 | 10/2007 | Yamaguchi et al. | |
| 2008/0063969 | A1 | 3/2008 | Yamaguchi et al. | |
| 2008/0073252 | A1 | 3/2008 | Yamaguchi et al. | |
| 2008/0213684 | A1 | 9/2008 | Nagayama et al. | |
| 2008/0227004 | A1 | 9/2008 | Yamaguchi et al. | |
| 2009/0029279 | A1* | 1/2009 | Mori et al. | 430/109.1 |
| 2009/0041510 | A1 | 2/2009 | Imahashi et al. | |
| 2009/0074450 | A1 | 3/2009 | Nagayama et al. | |
| 2009/0092920 | A1 | 4/2009 | Nagayama et al. | |
| 2009/0226218 | A1* | 9/2009 | Takatsuka et al. | 399/252 |
| 2010/0233613 | A1 | 9/2010 | Masuda et al. | |
| 2010/0239975 | A1 | 9/2010 | Yamaguchi et al. | |
| 2011/0065037 | A1 | 3/2011 | Iwatsuki et al. | |

FOREIGN PATENT DOCUMENTS

| | | |
|---|---|---|
| JP | 2008-224996 | 9/2008 |
| JP | 4234090 | 12/2008 |
| JP | 4246121 | 1/2009 |
| JP | 2009-230090 | 10/2009 |
| JP | 2010-117519 | 5/2010 |

OTHER PUBLICATIONS

U.S. Appl. No. 12/896,276, filed Oct. 1, 2010, Nakajima, et al.

Japanese Patent Office Communication with dispatch No. 762901 issued on Nov. 21, 2013 in Japanese Patent Application No. 2010-005096.

* cited by examiner

CARRIER, DEVELOPER USING THE CARRIER, AND DEVELOPING DEVICE, IMAGE FORMING METHOD, IMAGE FORMING APPARATUS AND PROCESS CARTRIDGE USING THE DEVELOPER

BACKGROUND OF THE INVENTION

1. Field of the Invention

The present invention relates to a carrier for use in a two component developer developing an electrostatic image, and to a two component developer using the carrier and a toner. In addition, the present invention also relates to a developing device, an image forming method, an image forming apparatus and a process cartridge using the two component developer.

2. Description of the Related Art

Electrophotographic image forming methods typically include the following processes:

(1) Forming an electrostatic latent image on an image bearing member such as a photoreceptor (electrostatic latent image forming process);

(2) Developing the electrostatic latent image with a developer including a toner to form a toner image on the image bearing member (developing process);

(3) Transferring the toner image onto a recording material (transferring process); and (4) Fixing the toner image on the recording material, resulting in formation of an output image (fixing process).

Recently, in the field of electrophotography, transition is rapidly being made from monochrome imaging to full color imaging, and the market for full color imaging is rapidly expanding.

In full color imaging, all the color images are formed by forming primary color toner images using four primary color toners, i.e., yellow, magenta, cyan and black toners, while forming secondary color toner images by overlaying two or more of the primary color toner images. Therefore, in order to prepare a full color image having a good combination of color reproducibility and clearness, the fixed color toner image preferably has a smooth surface to reduce light scattering at the surface. For this reason, color images produced by conventional full color image forming apparatus typically have a relatively high glossiness of from 10% to 50%.

With respect to the image fixing method, contact heat fixing methods in which a heated fixing member such as a heat roller or a belt is contacted with a toner image upon application of pressure thereto are widely used. Such contact heat fixing methods have advantages of fixing a toner image at a high speed and a high heat efficiency while imparting a good combination of glossiness and transparency to the fixed toner image. However, the contact heat fixing methods have a drawback in that they often cause an offset problem, in which a part of a toner image is adhered to a fixing member, and the adhered toner is transferred again to the image or another image, resulting in formation of an abnormal image, because the melted toner image is contacted with the fixing member upon application of heat and pressure thereto.

In attempting to prevent occurrence of the offset problem, typically fixing methods are used in which a fixing roller having a surface made of a material having good releasability such as silicone rubbers and fluorine-containing resins is used while applying a toner adhesion preventing agent such as silicone oils to the surface of the fixing roller. Although the fixing methods are effective in preventing occurrence of the offset problem, the methods have a drawback in that, since an oil applicator has to be provided, the fixing device becomes unacceptably large. Therefore, recent monochrome image forming apparatuses tend to use toner having a relatively high melt viscoelasticity and including a release agent in combination with an oil-less fixing device or an oil micro-coating fixing device, in which a small amount of oil is applied to a fixing member.

Similarly, oil-less fixing methods are often used for full color image forming apparatuses to miniaturize the fixing devices thereof and simplify the configuration. However, since full color image forming apparatuses preferably produce glossy images as mentioned above, color toners used therefor preferably have a lower viscoelasticity than toners used for monochrome image forming apparatuses, thereby increasing the chance of occurrence of the offset problem. Therefore, it is difficult for full color image forming apparatuses to use an oil-less fixing device.

In addition, toner including a release agent has drawbacks in that transferability of the toner to a recording material deteriorates because of having high adhesiveness to the surface of carrier, and a toner filming problem in that a film of toner is formed on the surface of the carrier used in combination of the toner, resulting in deterioration of the charging ability and durability (life) of the carrier On the other hand, coated carriers in which a resin including a carbon black is uniformly applied on a core material thereof are provided in order to prolong the life thereof, i.e., to prevent occurrence of the toner filming problem and other problems such that the surface of the carriers is oxidized, the moisture resistance of the carriers deteriorates, the durability of the carriers deteriorate, the carriers are adhered to image bearing members, and the carriers damage and abrade the surface of image bearing members, and to control the polarity and quantity of charge of the carriers.

Although developers using such coated carriers initially produce images with good image quality, the image quality tends to deteriorate as the number of copies produced by the developers increases because the coated layer of the carriers is abraded. In addition, when the coated layer is abraded or the carbon black in the coated layer is released therefrom, the color tone of color images tends to change because the color toner used for forming color images is mixed with the abraded layer or the released carbon black. In attempting to prevent occurrence of such problems, titanium oxide, zinc oxide or the like is used as a substitute for carbon black. However, the resistivity decreasing effect of such materials is worse than carbon black.

There is a proposal for a coated carrier in which a cover layer including a needle-shaped particulate conductive material, an antimony-doped tin oxide (ATO), is formed on a core material. However, since such an antimony-doped tin oxide has a blue color, developers using such a coated carrier tend to cause the above-mentioned color tone changing problem.

There is another proposal for a coated carrier in which a resin layer including a particulate conductive material, in which a tin dioxide layer and an indium oxide layer including tin dioxide are overlaid on a base material, is formed on a core material. Since such a conductive material includes a rare metal, the coated carrier has a relatively high cost. In addition, rare metals have poor availability.

In addition, there is another proposal for a coated carrier in which a cover layer including a resin, a first particulate conductive material which is a particulate tin oxide having carbon thereon, and a second particulate conductive material which includes a particulate metal oxide and/or a particulate metal salt subjected to an electroconductive treatment.

Electrophotographic full color image forming apparatuses often produce pictorial images, which typically have a high image area ratio. When developers including a toner including an external additive in a large amount and a coated carrier are used for electrophotographic full color image forming apparatuses and images having a high image area ratio are continuously produced, there is a case in which the charging ability of the carrier deteriorates.

For these reasons, the inventors recognized that there is a need for a carrier (or developer) which can produce high quality images for a long period of time regardless of the image area ratio of the images and which hardly causes the above-mentioned problems such as the toner filming problem and the color tone changing problem.

SUMMARY

This patent specification describes a novel carrier for use in a two component developer for developing an electrostatic latent image, one embodiment of which includes a particulate core material, and a cover layer located on a surface of the core material and including a silicone resin and barium sulfate. In addition, the cover layer includes Ba and Si at an atomic ratio of from 0.01 to 0.08, which is determined by X-ray photoelectron spectroscopy (XPS).

This patent specification further describes a novel two component developer for developing an electrostatic latent image, one embodiment of which includes a toner and the above-mentioned carrier.

This patent specification further describes a novel developing device, one embodiment of which includes a developer bearing member, which includes a non-magnetic developing sleeve including a fixed magnetic field generator therein and which rotates while bearing the above-mentioned developer thereon, and a developer layer forming member, which forms a layer of the developer on the surface of the developer bearing member to develop an electrostatic latent image with the developer layer and to form a toner image corresponding to the electrostatic latent image.

This patent specification further describes a novel image forming method, one embodiment of which includes forming an electrostatic latent image on an image bearing member; developing the electrostatic latent image with the above-mentioned two component developer to form a toner image on the image bearing member; transferring the toner image to a recording material; and fixing the toner image to the recording material.

This patent specification further describes a novel image forming apparatus, one embodiment of which includes an image bearing member configured to bear an electrostatic latent image; a developing device configured to develop the electrostatic latent image with the above-mentioned developer to form a toner image on the image bearing member; a transferring device configured to transfer the toner image onto a recording material; and a fixing device configured to fix the toner image on the recording material.

This patent specification further describes a novel process cartridge, one embodiment of which includes at least an image bearing member configured to bear an electrostatic latent image; and a developing device configured to develop the electrostatic latent image with the above-mentioned developer to form a toner image on the image bearing member, wherein the image bearing member and the developing device are integrated.

This patent specification further describes a novel image forming apparatus, one embodiment of which includes an image bearing member configured to bear an electrostatic latent image; a developing device configured to develop the electrostatic latent image with the above-mentioned two component developer to form a toner image on the image bearing member; a transferring device configured to transfer the toner image onto a recording material; and a fixing device configured to fix the toner image on the recording material.

BRIEF DESCRIPTION OF THE DRAWINGS

Amore complete appreciation of the aspects of the invention and many of the attendant advantage thereof will be readily obtained as the same better understood by reference to the following detailed description when considered in connection with the accompanying drawings, wherein.

DESCRIPTION OF THE PREFERRED EMBODIMENTS

Figure 1:
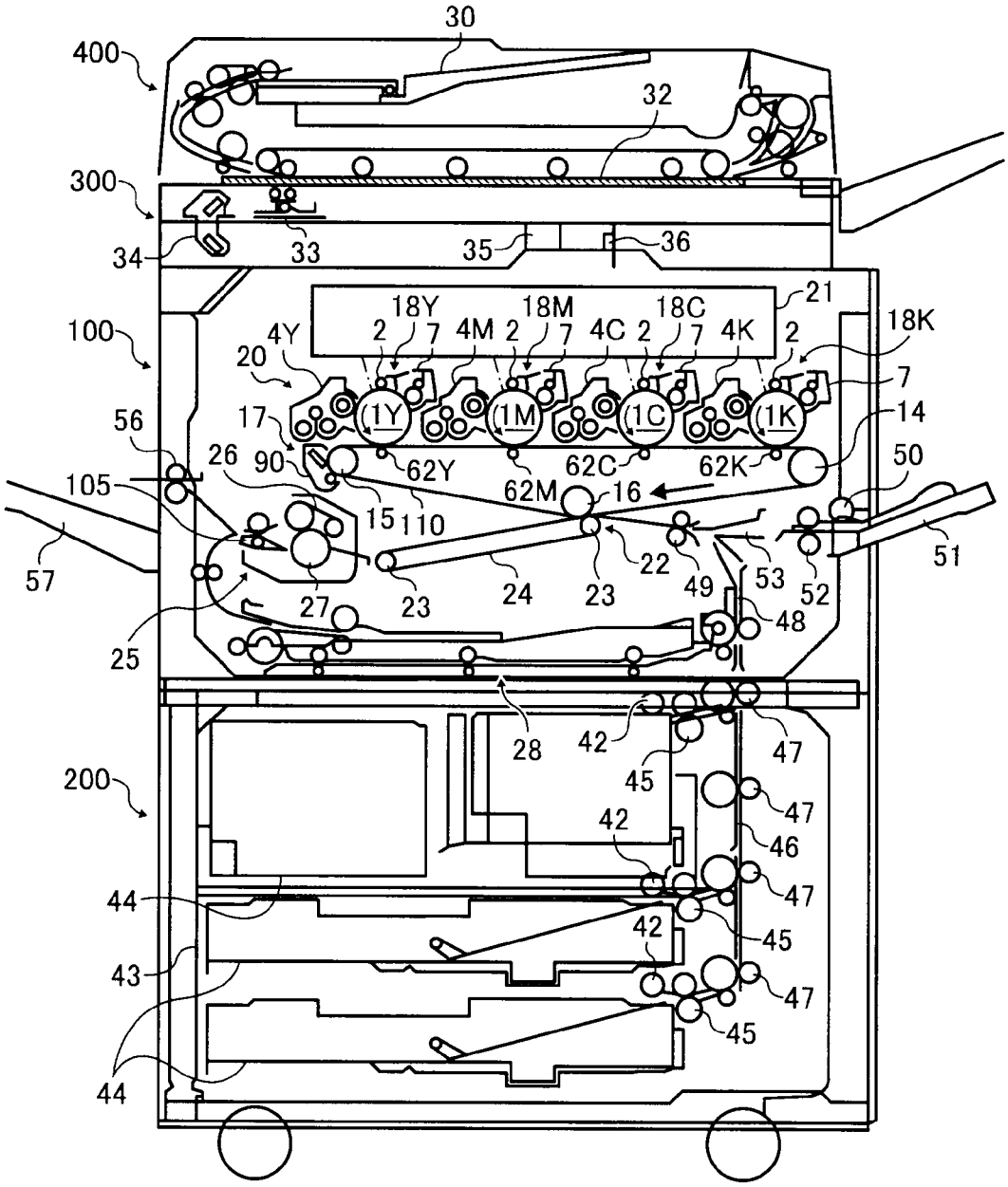
FIG. 1 is a schematic view illustrating an example of the image forming apparatus of the present invention.

Initially, the carrier of the present invention will be described.

The carrier of the present invention includes a particulate core material, and a cover layer located on a surface of the core material and including a silicone resin and barium sulfate, wherein the cover layer includes Ba and Si at an atomic ratio of from 0.01 to 0.08, which is determined by X-ray photoelectron spectroscopy (XPS).

As a result of study of the coated layer of carrier, it is discovered that by including barium sulfate in a surface portion of a cover layer formed on a core material of carrier, the stability of charging ability of the carrier can be enhanced.

Specifically, barium sulfate has great ability at charging toner while having a property such that external additives of toner and resins included in toner particles are hardly adhered thereto, i.e., barium sulfate hardly causes a spent toner problem in that toner components (such as binder resins and additives) are adhered to the surface of carrier, thereby deteriorating the charging ability of the carrier. The reason therefor is considered to be that, since barium sulfate is harder than the resin of the cover layer, barium sulfate included in the cover layer of a carrier particle can easily remove toner components adhered to the surfaces of other carrier particles when contacted with the carrier particles. Therefore, it is preferable that barium sulfate is present in a surface portion of the cover layer. By including barium sulfate in a surface portion of a cover layer of a carrier, the resultant carrier can maintain a good charging ability for a long period of time even when images having a high image area ratio are produced.

By contrast, silicone resins have a relatively low hardness. Therefore, a silicone resin included in a cover layer of a carrier is abraded after long repeated use. In this case, when a particulate material included in the cover layer is released from the surface of the carrier, the released particulate material is mixed with the toner, resulting in occurrence of the color tone changing problem and a background development problem in that background portions of images are soiled with the toner and/or the released particulate material. However, since barium sulfate has a charge having a polarity opposite to that of the charge of the toner, barium sulfate is hardly used for developing. In addition, even though barium sulfate is transferred to background portions of images formed on an image bearing member in a developing process, barium sulfate is not transferred to a recording material. Further, since barium sulfate has a white color, the color tones of images are hardly changed even when barium sulfate is mixed with the color toners used. Therefore, even when a coated layer of a carrier including barium sulfate is released from the surface of the carrier and the released layer is adhered to electrostatic latent images, the color tones of images are hardly changed. Thus, even when an abrasive resin such as silicone resins is used for a cover layer, the above-mentioned problems are hardly caused if barium sulfate is used for the cover layer. In addition, when images having a high image area ratio are produced for a long period of time while frequently supplying a supplementary toner to the developing device, the carrier can maintain a good charging ability.

Silicone resins have a drawback in that when a particulate material is mixed with a silicone resin, the particulate material is easily agglomerated. When such a mixture is coated on the surface of a core material of carrier to form a cover layer thereon, the agglomerated particulate material is easily released from the cover layer, and the released particulate material is mixed with the developer, resulting in deterioration of the charge property (such as distribution of charge quantity) of the toner, thereby causing the background development problem and a toner scattering problem in that the toner in the developing device is scattered around the developing device and other devices of the image forming apparatus in the vicinity of the developing device, resulting in contamination of the devices. However, barium sulfate has good dispersing property and can be satisfactorily dispersed in a silicone resin. Therefore, barium sulfate is dispersed in a cover layer without agglomerated, and is not easily released from the cover layer. Accordingly, the background development problem and the toner scattering problem are hardly caused.

In this regard, the atomic ratio Ba/Si of the barium content (Ba) to the silicon content (Si) based on all the elements included in the coated carrier, which is determined by X-ray photoelectron spectroscopy (XPS), is from 0.01 to 0.08. When the atomic ratio Ba/Si is less than 0.01, the resultant carrier cannot have a sufficient charging ability, thereby insufficiently charging toner, resulting in occurrence of the background development problem and the toner scattering problem. In addition, the cover layer is easily abraded, resulting in occurrence of a carrier adhesion problem in that carrier particles are adhered to electrostatic latent images on an image bearing member.

By contrast, when the atomic ratio Ba/Si is greater than 0.08, the carrier excessively charges toner, and therefore the developer has an insufficient developing ability. In addition, since the added amount of barium sulfate is too large, barium sulfate cannot be satisfactorily dispersed in a cover layer coating liquid, resulting in formation of a cover layer in which barium sulfate is agglomerated. Therefore, barium sulfate is easily released from the resultant cover layer, resulting in abrasion of the cover layer, thereby causing the background development problem and the toner scattering problem.

The atomic ratio Ba/Si is preferably from 0.03 to 0.08. This is because, for example, when images having a high image area ratio for use in commercial printing are produced over a long period of time, the toner used in combination with the carrier is often charged unsatisfactorily if the ratio is less than 0.03.

The atomic ratio of Ba to all the elements detected by XPS is preferably from 0.2 atomic percent to 1.2 atomic percent (on a number basis). When the ratio is less than 0.2 atomic percent, the resultant carrier often has an insufficient charging ability, thereby easily causing the background development problem and the toner scattering problem. By contrast, when the atomic ratio is greater than 1.2 atomic percent, the resultant carrier often imparts an excessive charge to toner, resulting in deterioration of the developing property of the toner.

In order to adjust the atomic ratio Ba/Si, it is preferable to adjust the amount of barium sulfate added to the cover layer.

When a cover layer coating liquid including barium sulfate is prepared, barium sulfate is preferably dispersed as finely as possible in a dispersing process. This is because finely dispersed barium sulfate has a greater surface area and the area of the surface of the resultant cover layer is increased. In addition, since the mechanical strength of the resultant cover layer is also enhanced, the resistance of carrier particles is hardly decreased even when a relatively strong stress is applied to the carrier.

In this application, the atomic ratio Ba/Si is determined by XPS. The instrument used for determining the ratio Ba/Si and the measuring conditions thereof are as follows.

1. Instrument: AXIS-ULTRA from Kratos Analytical
2. Measuring Conditions
   (1) Light source: Al (in combination with monochromator)
   (2) Measurement power: 90 W (15 kV and 6 mA)
   (3) Measurement region: 900×600 $\mu m^2$
   (4) Pass energy: 160 eV (wide scan), 40 eV (narrow scan)
   (5) Energy step: 1.0 eV (wide scan), 0.2 eV (narrow scan)
   (6) Relative sensitivity coefficient: Relative sensitivity coefficients presented by Kratos Analytical are used.
   (7) Magnet controller: OFF (because carrier is a magnetic material)

The measuring method is as follows. Initially, a sample is contained in a cylindrical hole of a chip having a depth of 0.3 mm and a flat surface of the sample is subjected to XPS. The instrument outputs amounts (contents) of all the elements included in a surface portion of the cover layer in units of atomic percent. The atomic ratio Ba/Si is determined from the amounts (contents) of Ba and Si.

Suitable materials for use as the silicone resin included in the cover layer of the carrier of the present invention include known silicone resins such as straight silicones consisting of organo-siloxane bonds, and modified silicone resins such as alkyd-modified silicone resins, polyester-modified silicone resins, epoxy-modified silicone resins, acrylic-modified silicone resins, and urethane-modified silicone resins, but are not limited thereto.

Specific examples of marketed straight silicone resins include KR271, KR255 and KR152, which are manufactured by Shin-Etsu Chemical Co., Ltd.; SR2400, SR2406 and SR2410, which are manufactured by Dow Corning Toray Silicone Co., Ltd.; etc. In this regard, such straight silicone resins can be used alone or in combination with crosslinkable components and/or charge controlling components. Specific examples of marketed modified silicone resins include KR206 (alkyd-modified silicone resin), KR5208 (acrylic-modified silicone resin), ES1001N (epoxy-modified silicone resin), and KR305 (urethane-modified silicone resin), which are manufactured by Shin-Etsu Chemical Co., Ltd.; SR2115 (epoxy-modified silicone resin), and SR2110 (alkyd-modified silicone resin), which are manufactured by Dow Corning Toray Silicone Co., Ltd.; etc.

Other resins can be used for the cover layer in combination with silicone resins. Specific examples of such resins include polyolefins such as polyethylene and polypropylene; styrene resins; acrylic resins; acrylonitrile resins; crosslinking copolymers obtained by polymerizing monomers such as vinyl acetate, vinyl chloride, vinyl carbazole, and vinyl ether;

polyamide resins; polyester resins; polyurethane resins; polycarbonate resins; urea resins; melamine resins; benzoguanamine resins; epoxy resins; ionomer resins; polyimide resins; and derivatives of these resins.

When another resin is used in combination with a silicone resin, the atomic percentage is calculated while assuming that the atomic percentage of Si in the silicone resin is 100%. Specifically, when a combination of a silicone resin and another resin in a ratio of 1/1 (i.e., the content of a silicone resin in the cover layer is 50% by weight) is used for the cover layer and, the detected value of Si in XPS is doubled to determine the Ba/Si ratio.

The cover layer of the carrier of the present invention preferably includes a particulate electroconductive material. Suitable materials for use as the electroconductive material include tin oxides. Among tin oxides, tin oxides free from antimony are preferably used.

In general, tin oxides are covered with antimony and/or indium to control the resistivity of powders of the tin oxides. Antimony is harmful to human being and the environment. In addition, since antimony-containing tin oxides have a blue color, it is possible to cause the color tone changing problem similarly to carbon black. In addition, indium oxides have a drawback in that indium is a rare metal and has poor availability, high costs, and a narrow resistivity controllable range. Therefore, it is preferable to use tine oxides free from antimony and indium.

It is important to control the resistivity of carrier in order to produce images having good image qualities.

For example, when the resistivity of a carrier used for a developer is relatively high, counter charges formed on the carrier after a developing process slowly decays. Such a carrier has poor charge imparting ability to a supplementary toner supplied to the developing device, and the content of insufficiently charged toner particles in the developer increases, resulting in occurrence of the background development problem. Alternatively, due to the counter charges remaining on the carrier, the developer is strongly adhered to a developing sleeve (i.e., the developer to be released from the developing sleeve remains on the developing sleeve while being rotated), resulting in formation of low-density images or uneven-density images (when the developer used for development and including toner in a small amount is mixed with a developer including the toner in a proper amount). Particularly, when images having a high image area ratio are produced, this uneven density problem is remarkably caused.

Thus, as mentioned above, a cover layer including antimony-free tin oxide has a good resistivity controlling ability, and can rapidly decay counter charges formed on the carrier, and therefore has a good ability to impart a charge to a supplementary toner, resulting in prevention of occurrence of the background development problem and the uneven density problem.

The logarithmic resistivity (log R (Ω·cm)) of an electroconductive material included in the cover layer is preferably from 0.5 to 3. When the logarithmic resistivity of the electroconductive material included in the cover layer is less than 0.5, it becomes difficult to prepare a coated carrier having even resistivity. By contrast, when the logarithmic resistivity of the electroconductive material included in the cover layer is greater than 3, it becomes difficult to decrease the volume resistivity of the carrier.

The logarithmic resistivity of an electroconductive material is measured by the following method.

At first, a sample is contained in a cylindrical polyvinyl chloride tube having a diameter of 1 inch (i.e., 2.54 cm) and equipped with an electrode at the bottom thereof, and an electrode having a diameter of 1 inch is inserted from the top of the tube to sandwich the sample with the two electrodes. While a pressure of 10 kg/cm$^2$ is applied to the electrodes using a pressing machine, the resistance (r (Ω)) of the sample is measured with an LCR meter 4216A from Hewlett Packard Japan Ltd. The logarithmic resistivity (log R (Ω·cm)) of the sample is calculated from the following equation (1):

$$\log R(\Omega\cdot\text{cm})=\log\left[r\times\pi(2.54/2)^2/H\right] \quad (1),$$

wherein H represents the distance (in units of cm) between the two electrodes (i.e., the thickness of the sample).

The cover layer of the carrier of the present invention preferably includes a silane coupling agent to enhance the stability of the carrier after long repeated use. Suitable materials for use as the silane coupling agent include methyltrimethoxysilane, methyltriethoxysilane, octyltrimethoxysilane, aminosilanes, etc., but are not limited thereto. Among these silane coupling agents, aminosilanes are preferable. Specific examples thereof include the following compounds.

$H_2N(CH_2)_3Si(OCH_3)_3$
$H_2N(CH_2)_3Si(OC_2H_5)_3$
$H_2N(CH_2)_3Si\ (CH_3)_2(OC_2H_5)$
$H_2N(CH_2)_3Si\ (CH_3)(OC_2H_5)_2$
$H_2N(CH_2)_2(NH)(CH_2)Si(OCH_3)_3$
$H_2N(CH_2)_2(NH)(CH_2)_3Si\ (CH_3)(OCH_3)_2$
$H_2N(CH_2)_2(NH)(CH_2)_3Si(OCH_3)_3$
$(CH_3)_2N(CH_2)_3Si\ (CH_3)(OC_2H_5)_2$
$(C_4H_9)_2N(CH_2)_3Si(OCH_3)_3$

The content of an aminosilane in the cover layer is preferably from 0.001% to 30% by weight, and more preferably from 0.001% to 15% by weight. When the content is less than 0.001% by weight, the carrier durability enhancing effect is hardly produced. By contrast, when the content is greater than 30% by weight, it becomes difficult for the cover layer to hold a particulate electroconductive material and/or a particulate inorganic material therein.

The cover layer of the carrier of the present invention preferably has an average thickness of from 0.1 μm to 0.8 μm. When the thickness is less than 0.1 μm, the cover layer tends to be easily released from the core particles by mechanical stress caused in a developing device. In this case, the resistivity of the carrier may fall out of the preferable range of from 10 to 15 log (Ω·cm). By contrast, when the thickness is greater than 0.8 μm, the amount of resin components in the cover layer excessively increases, thereby causing a carrier agglomeration problem in that multiple carrier particles are adhered to each other. In this case, the volume average particle diameter of the carrier may fall out of the preferable range of from 15 μm to 40 μm.

Figure 5:
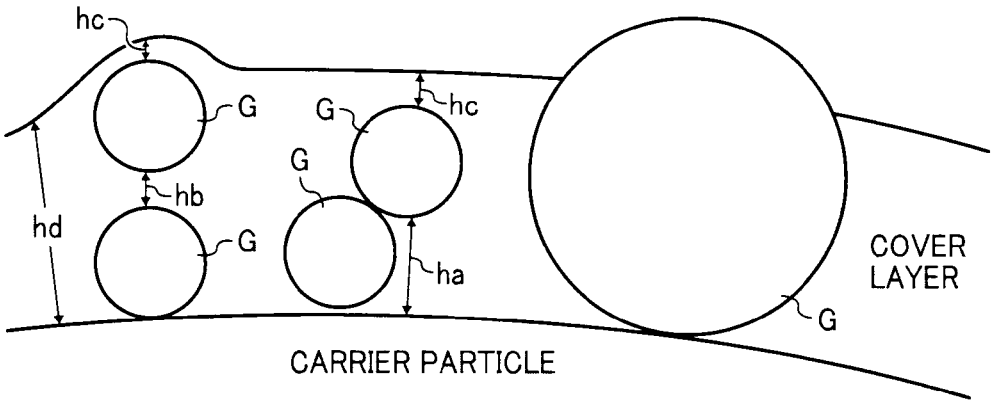
FIG. 5 is a cross sectional view illustrating an example of the cover layer of the carrier of the present invention.

The average thickness of the cover layer means the average thickness h (μm) of the resinous portion of the cover layer, which is determined as follows. Specifically, the cross sections of carrier particles are observed with a transmission electron microscope (TEM) to determine thicknesses of 50 points of the resinous portions. In this regard, the thicknesses of only resinous portions present between a barium sulfate particle and the surface of the core material and resinous portions constituting the cover layer by itself are measured. Namely, in FIG. 5 illustrating an example of the cover layer, among thicknesses ha, hb, hc and hd, only the thicknesses ha and hd of resinous portions of the cover layer are measured. The average thickness h (in units of micrometer) of the cover layer is determined by averaging the 50 thickness data thus obtained. In FIG. 5, reference character G denotes particles of barium sulfate.

The weight ratio (S/C) of the weight (S) of a silicone resin included in the cover layer to the weight (C) of the core material of the carrier is preferably from 0.0005 to 0.10 (i.e., 0.05% to 10.0% by weight), and more preferably from 0.001 to 0.7 (i.e., 0.1% to 7.0% by weight). In this regard, the weight ratio (S/C) is properly determined depending on the specific surface area of the core particles. Namely, it is preferable that the area of surface portions of core particles not covered with the cover layer is as small as possible to minimize variation in resistance, charge quantity and fluidity of the developer. The thickness of the resinous portion of the cover layer of the carrier is preferably from 0.1 μm to 0.8 μm.

The core material of the carrier of the present invention is not particularly limited, and a proper material is selected from any known materials for use as carriers in electrophotographic two component developers can be used so as to fulfill the purpose of the resultant carrier. Specific examples of the materials for use as the core material include ferrite, Cu—Zn ferrite, Mn ferrite, Mn—Mg ferrite, Mn—Mg—Sr ferrite, magnetite, iron, nickel, etc.

The carrier of the present invention preferably has a volume average particle diameter of from 15 μm to 40 μm. When the volume average particle diameter is less than 15 μm, the uniformity of the carrier tends to deteriorate, and a carrier adhesion problem in that carrier particles adhere to electrostatic latent images tends to occur. In addition, there is no image forming apparatus which can make full use of such a small carrier. By contrast, when the volume average particle diameter is greater than 40 μm, reproducibility of fine images tends to deteriorate.

The volume average particle diameter of the carrier is measured with a particle size analyzer, MICROTRACK SRA from Nikkiso Co., Ltd. The measuring conditions are as follows.

Particle diameter range: 0.7 μm to 125 μm

Dispersing medium used: methanol

Refractive index of dispersing medium: set to 1.33

Refractive index of carrier (or core material): set to 2.42

The logarithmic volume resistivity of the carrier of the present invention is preferably from 10 to 15 log(Ω·cm). When the volume resistivity is less than 10 log(Ω·cm), the carrier adhesion problem tends to occur. By contrast, when the volume resistivity is greater than 15 log(Ω·cm), an edge-effect problem in that edge portions of an image has a higher image density than central portions of the image tends to be caused.

Figure 4:
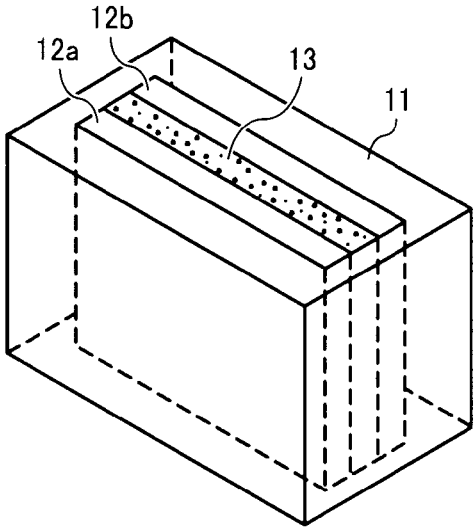
FIG. 4 is a schematic view illustrating a cell used for measuring the volume resistivity of a carrier.

The volume resistivity of a carrier is measured using a cell illustrated in FIG. 4. Specifically, a carrier 13 is contained in a cell 11, which is made of a fluorine-containing resin and which has electrodes 12*a* and 12*b*, wherein each of the electrodes 12*a* and 12*b* has a surface of 2 cm×4 cm and the distance between the electrodes 12*a* and 12*b* is 0.2 cm. After the carrier is fed into the cell 11 so as to overflow from the cell without applying a pressure to the carrier, the cell is tapped for 1 minute at a tapping speed of 30 times per minute, and a nonmagnetic flat blade is slid once along the upper surface of the cell to remove the projected portion of the carrier projected from the upper surface of the cell. Next, a DC voltage of 1,000V is applied between the electrodes 12*a* and 12*b*, and the resistance r (Ω) of the carrier is measured with an instrument, HIGH RESISTANCE METER 4329A from Hewlett-Packard Japan, Ltd. The volume resistivity R (Ω·cm) of the carrier is calculated from the following equation (2):

$$R=r(2\times4)/0.2 \quad (2).$$

The logarithmic volume resistivity (log R(Ω·cm)) is obtained by taking logarithms of the volume resistivity R (Ω·cm).

If the current is excessively large and cannot be measured when measuring the resistance r of the carrier using HIGH RESISTANCE METER 4329A, the resistivity of the carrier is not determined and it is assumed that and the carrier causes breakdown.

The carrier of the present invention preferably has a magnetization intensity per a unit weight of from 40 $Am^2/kg$ to 90 $Am^2/kg$ at a magnetic field of 1 kOe ($10^6/4\pi$ [A/m]). When the magnetization intensity of the carrier falls in this range, the retention force between carrier particles can be properly maintained, and toner can be rapidly dispersed in the carrier particles. When the magnetization intensity is lower than 40 $Am^2/kg$, the carrier adhesion problem tends to be caused. By contrast, when the magnetization intensity is greater than 90 $Am^2/kg$, the magnetic brush formed on a developer bearing member becomes too hard, thereby deteriorating image reproducibility to an extent such that fine images cannot be satisfactorily reproduced.

The method for measuring the magnetization intensity is as follows.

(1) One (1.0) gram of a sample (core material) is set in a cylindrical cell of a B-H TRACER BHU-60 from Riken Denshi Co., Ltd., which cell has an inside diameter of 7 mm and a height of 10 mm;

(2) A magnetic field is applied thereto while gradually changed from 0 to 3 kOe;

(3) Next, the magnetic field is gradually decreased from 3 to 0 kOe;

(4) Further the opposite magnetic field is applied thereto while gradually changed from 0 to 3 kOe;

(5) Furthermore the opposite magnetic field is gradually decreased from 3 to 0 kOe; and (6) Furthermore the first-mentioned magnetic field is again applied thereto to prepare a B-H curve of the sample and to determine the magnetization intensity of the sample at 1 kOe.

The developer of the present invention includes the carrier of the present invention and a toner. By using the developer for an image forming apparatus having a developing device in which the developer is supplied to the developing device as a supplementary developer while discharging excess developer from the developing device, high quality images can be reliably produced over a long period of time. In this case, degraded carrier particles in the developing device are discharged to be replaced with fresh carrier particles included in the supplementary developer, and therefore the carrier maintains good charging ability over a long period of time, thereby reliably forming high quality images.

This image forming method is particularly preferable for forming images having a high image area ratio. When images having a high image area ratio are formed, the spent toner problem is often caused and the carrier is degraded. However, by using the image forming method mentioned above, high quality images can be reliably produced over a long period of time because the carrier of the present invention has good resistance to the spent toner problem while degraded carrier particles in a developing device are replaced with fresh carrier particles included in the supplementary developer.

The supplementary developer preferably includes a toner in an amount of from 2 to 50 parts by weight per 1 part by weight of the carrier of the present invention. When the amount of toner is less than 2 parts by weight, too large an amount of carrier particles are supplied to a developing device, thereby excessively increasing the content of the carrier in the developer. In this case, the toner has too high a charge quantity, resulting in formation of low density images. By contrast, when the amount of toner is greater than 50 parts by weight, replacement of degraded carrier particles with fresh carrier particles is not satisfactorily performed, and therefore the effect of preventing the carrier from deteriorating cannot be satisfactorily produced.

Next, the toner used for the developer of the present invention will be described.

The toner includes a binder resin, and a colorant as main components.

Specific examples of the resins for use as the binder resin of the toner include homopolymers of styrene and substituted styrene such as polystyrene, poly-p-chlorostyrene and polyvinyl toluene; styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, and styrene-maleic acid ester copolymers; acrylic resins such as polymethyl methacrylate and polybutyl methacrylate; and other resins such as polyvinyl chloride, polyvinyl acetate, polyethylene, polyester resins, polyurethane resins, epoxy resins, polyvinyl butyral resins, polyacrylic acid resins, rosin, modified rosins, terpene resins, phenolic resins, aliphatic or aromatic hydrocarbon resins, aromatic petroleum resins, etc. These resins are used alone or in combination.

Not only the heat-fixable resins mentioned above but also pressure-fixable resins can be used as the binder resin of the toner. Specific examples of the resins for use as the pressure-fixable binder resin include polyolefin (e.g., low molecular weight polyethylene and low molecular weight polypropylene); olefin copolymers (e.g., ethylene-acrylic acid copolymers, ethylene-acrylate copolymers, ethylene-methacrylic acid copolymers, ethylene-methacrylate copolymers, ethylene-vinyl chloride copolymers, ethylene-vinyl acetate copolymers, and ionomer resins); other resins such as epoxy resins, polyester resins, styrene-butadiene copolymers, polyvinyl pyrrolidone, methyl vinyl ether-maleic anhydride copolymers, maleic acid-modified phenolic resins, phenol-modified terpene resins, etc. These resins are used alone or in combination.

The toner optionally includes a fixation assisting agent so as to be used for oil-less fixing devices in which an oil for preventing adhesion of toner to a fixing member (such as a fixing roller) is not applied. Specific examples of such a fixation assisting agent include polyolefins such as polyethylene and polypropylene; fatty acid metal salts, fatty acid esters, paraffin waxes, amide waxes, polyalcohol waxes, silicone varnishes, carnauba waxes, ester waxes, etc., but are not limited thereto.

Various colorants (pigments and dyes) for use in preparing yellow, magenta, cyan and black color images, such as yellow, orange, red, violet, blue, green, and black pigments and dyes can be used for the toner used in combination with the carrier of the present invention. These colorants are used alone or in combination.

Specific examples of the yellow colorants include Cadmium Yellow, Mineral Fast Yellow, Nickel Titan Yellow, Naples Yellow, NEPHTHOL YELLOW S, HANZA YELLOW G, HANZA YELLOW 10G, BENZIDINE YELLOW GR, Quinoline Yellow Lake, PERMANENT YELLOW NCG, Tartrazine Lake, etc.

Specific examples of the orange colorants include Molybdenum Orange, PERMANENT ORANGE GTR, Pyrazolone Orange, VULVAN ORANGE, INDANTHRENE BRILLIANT ORANGE RK, BENZIDINE ORANGE G, INDANTHRENE BRILLIANT ORANGE GK, etc.

Specific examples of the red colorants include red iron oxide, cadmium red, PERMANENT RED 4R, Lithol Red, Pyrazolone Red, Watchung Red calcium salt, Lake Red D, Brilliant Carmine 6B, Eosin Lake, Rhodamine Lake B, Alizarine Lake, Brilliant Carmine 3B, etc.

Specific examples of the violet colorants include Fast Violet B, and Methyl Violet Lake, etc.

Specific examples of the blue colorants include cobalt blue, Alkali Blue, Victoria Blue Lake, Phthalocyanine Blue, metal-free Phthalocyanine Blue, partially-chlorinated Phthalocyanine Blue, Fast Sky Blue, INDANTHRENE BLUE BC, etc.

Specific examples of the green colorants include Chrome Green, chromium oxide, Pigment Green B, Malachite Green Lake, etc.

Specific examples of the black colorants include carbon black, oil furnace black, channel black, lamp black, acetylene black, azine dyes such as aniline black, metal salts of azo dyes, metal oxides, complex metal oxides, etc.

These colorants can be used alone or in combination.

The toner can optionally include a charge controlling agent. Specific examples of such a charge controlling agent include Nigrosine, azine dyes having 2 to 16 carbon atoms (disclosed in published examined Japanese patent application No. 42-1627), basic dyes, lake pigments of basic dyes, quaternary ammonium salts, dialkyltin compounds, dialkyltin borate compounds, guanidine derivatives, polyamine resins, metal complexes of monoazo dyes, metal complexes of acids such as salicylic acid derivatives, sulfonated copper phthalocyanine pigments, organic boron salts, fluorine-containing quaternary ammonium salts, calixarene compounds, etc. These compounds can be used alone or in combination.

Specific examples of the basic dyes include C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000), and lake pigments of these basic dyes.

Specific examples of the quaternary ammonium salts include C.I. Solvent Black 8 (C.I. 26150), benzoylmethylhexadecylammonium chloride, and decyltrimethylammonium chloride.

Specific examples of the dialkyltin compounds include dibutyltin compounds, and dioctyltin compounds.

Specific examples of the polyamine resins include vinyl polymers having an amino group, and condensation polymers having an amino group.

Specific examples of the metal complexes of monoazo dyes include metal complexes of monoazo dyes disclosed in published examined Japanese patent applications Nos. (hereinafter JP-B) 41-20153, 43-27596, 44-6397, and 45-26478.

Specific examples of the metal complexes of acids include metal (e.g., Zn, Al, Co, Cr and Fe) complexes of salicylic acid, salicylic acid derivatives (e.g., compounds disclosed in JP-Bs 55-42752 and 59-7385), dialkylsalicylic acids, naphthoic acid, and dicarboxylic acids.

Among these charge controlling agents, metal complexes of salicylic acid derivatives having a white color are preferably used for color toners.

The toner for use in the developer of the present invention preferably includes toner particles including the above-mentioned toner components such as binder resins, colorants, fixation assisting agents, and charge controlling agents, and an external additive present on the surface of the toner particles. Such an external additive covers toner particles to enhance the transferability and durability of the toner. Specifically, even when toner components (such as waxes), which are included in the toner particles and which tend to deteriorate the transferability and durability when being exuded from the toner particles, are exuded from the toner particles, deterioration of transferability and durability of the toner can be prevented because the external additive covers the toner particles. In addition, when the surface of toner particles is covered with such an external additive, the area of contact portions of toner particles with each other and developing members such as developing rollers is decreased, thereby producing the effect.

Materials for use as the external additive are not particularly limited, and known materials for use as external additives of toner can be used.

Specific examples of such an external additive include particulate inorganic materials (such as silica, titanium oxide, alumina, silicon carbide, silicon nitride and boron nitride), particulate resins, etc.

It is preferable for such inorganic materials to be hydrophobized, and hydrophobized metal oxides such as silica and titanium oxide are preferably used.

Specific examples of such particulate resins include particulate polymers (such as polymethyl methacrylate and polystyrene), which are prepared by a soap-free emulsion polymerization method and which have an average particle diameter of from 0.05 μm to 1 μm.

These materials for use as the external additive are used alone or in combination Among these materials, metal oxides such as silica and titanium oxide, whose surface is hydrophobized, are preferable. It is more preferable to use a combination of a hydrophobized silica and a hydrophobized titanium oxide, wherein the added amount of hydrophobized silica is greater than that of the hydrophobized titanium oxide, so that the resultant toner can maintain good charge stability even when environmental humidity changes.

In addition, another external additive having a relatively large particle diameter compared to conventional external additives can also be used in combination with the above-mentioned external additive to enhance the durability of the toner. Specific examples thereof include silica having a specific surface area of from 20 to 50 $m^2/g$, and particulate resins having a particle diameter of from 1/100 to 1/8 of the particle diameter of the toner particles. The reason why the durability of the toner can be enhanced by such a large external additive is as follows.

In general, when a toner is mixed with a carrier in a developing device so as to be charged and to be used for developing electrostatic latent images, an external additive (such as a metal oxide) present on the toner particles tends to be embedded into the toner particles. In this case, when such a relatively large external additive is used in combination with the external additive, the external additive is prevented from being embedded into the toner particles.

The above-mentioned particulate inorganic materials and particulate resins can also be used as internal additives of toner, which are included in the toner particles. In this case, transferability and durability of the toner can also be enhanced although the effect of enhancing the transferability and durability is less than that in a case where the materials are used as external additives. In addition, when toner including such an internal additive is prepared by a pulverization method in which toner components are kneaded and then pulverized, pulverizability of the kneaded toner components can be enhanced.

Further, it is also preferable for the toner to include both an internal additive and an external additive, because the external additive is effectively prevented from being embedded into toner particles, resulting in enhancement of the transferability and durability of the toner.

Specific examples of the hydrophobizing agents for use in preparing hydrophobized external additives include dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinyltrimethoxysilane, vinyl-tris (β-methoxyethoxy)silane, γ-methacryloxypropyltrimethoxysilane, vinyltriacetoxysilane, divinyldichlorosilane, dimethylvinylchlorosilane, octyltrichlorosilane, decyltrichlorosilane, nonyltrichlorosilane, (4-t-propylphenyl) trichlorosilane, (4-t-butylphenyl)trichlorosilane, dipentyldichlorosilane, dihexyldichlorosilane, dioctyldichlorosilane, dinonyldichlorosilane, didecyldichlorosilane, didodecyldichlorosilane, dihexadecyldichlorosilane, (4-t-butylphenyl) octyldichlorosilane, dioctenyldichlorosilane, didecenyldichlorosilane, dinonenyldichlorosilane, di-2-ethylhexyldichlorosilane, di-3,3-dimethylpentyldichlorosilane, trihexylchlorosilane, trioctylchlorosilane, tridecylchlorosilane, dioctylmethylchlorosilane, octyldimethylchlorosilane, (4-t-propylphenyl) diethylchlorosilane, octyltrimethoxysilane, hexamethyldisilazane, hexaethyldisilazane, diethyltetramethyldisilazane, hexaphenyldisilazane, hexatolyldisilazane, etc. In addition, titanate coupling agents and aluminum coupling agents can also be used.

A clean ability improving external additive can also be used for the toner in combination of such an external additive as mentioned above. Specific examples thereof include lubricants such as fatty acid metal salts and particulate polyvinylidene fluoride resins.

The method for preparing the toner for use in the developer of the present invention is not particularly limited. Specific examples of the method include pulverization methods, polymerization methods, etc.

Pulverization methods typically include the following processes:

(1) Kneading toner components such as a binder resin and a colorant upon application heat and shearing force thereto;

(2) Cooling the kneaded toner component mixture to solidify the mixture;

(3) Pulverizing the solidified mixture;

(4) Classifying the pulverized toner component mixture, thereby preparing toner particles (i.e., a mother toner); and (5) Mixing an external additive with the toner particles to improve the durability thereof, resulting in preparation of a toner.

Specific examples of the kneading machines include batch kneading machines such as two-roll mills, and BANBURY MIXER, and continuous kneaders such as twin screw extruders and single screw extruders. Specific examples of the twin screw extruders include KTK twin screw extruders from Kobe Steel, Ltd., TEM twin screw extruders from Toshiba Machine Co., Ltd., twin screw extruders from KCK Co., Ltd., PCM twin screw extruders from Ikegai Corp., KEX twin screw extruders from Kurimoto Ltd., etc. Specific examples of the continuous single screw extruders include KO-KNEADER from Buss AG.

In the pulverization process, it is preferable to crush the solidified mixture using a crusher such as hammer mills, and cutter mills (e.g., ROTOPLEX from Hosokawa Micron Corp.), and then pulverizing the crushed toner component mixture using a pulverizer such as jet air pulverizers and mechanical pulverizers. In this regard, it is preferable to perform pulverization so that the resultant toner particles have an average particle diameter of from 3 μm to 15 μm.

It is preferable to use an air classifier for the classification process. In the classification process, the toner particles are classified so as to have an average particle diameter of from 5 μm to 20 μm.

The external additive adding process is performed using a mixer so that an external additive is adhered to the surface of toner particles while dissociated. In this case, it is important that the external additive is evenly and strongly adhered to the toner particles to enhance the durability of the resultant toner.

The method for preparing the toner for use in the developer of the present invention is not limited to the methods mentioned above.

Next, the image forming method and apparatus, and the process cartridge of the present invention will be described.

The image forming method of the present invention includes:

(1) An electrostatic latent image forming process in which an electrostatic latent image is formed on an image bearing member (such as a photoreceptor);

(2) A developing process in which the electrostatic latent image is developed with the developer of the present invention to form a toner image on the image bearing member;

(3) A transfer process in which the toner image on the image bearing member is transferred onto a recording material; and (4) A fixing process in which the toner image is fixed to the recording material, resulting in formation of a copy.

The image forming method optionally includes:

(5) A cleaning process in which toner particles remaining on the image bearing member even after the transfer process are removed using a cleaner; and (6) A discharging process in which charges remaining on the image bearing member even after the transfer process are removed using a discharger.

Next, the image forming method and apparatus of the present invention will be described in detail by reference to FIG. 1.

FIG. 1 illustrates a tandem full color image forming apparatus as an example of the image forming apparatus of the present invention using the developer of the present invention.

The image forming apparatus illustrated in FIG. 1 includes a main body 100 thereof, a sheet feeding section 200 located below the main body, a scanner 300 located above the main body, and an automatic document feeder 400 located above the scanner.

In a center of the main body 100, a secondary transfer unit 17 including an intermediate transfer belt 110, which includes a flexible endless belt and tightly stretched across multiple rollers 14, 15 and 16, is provided. One of the rollers is rotated by a driving device (not shown) to rotate the intermediate transfer belt 110 in a direction indicated by an arrow, and the other rollers are rotated by the thus-rotated intermediate transfer belt. In addition, the main body 100 includes a tandem image forming section 20 including four image forming units 18 (18Y, 18M, 18C and 18K) configured to respectively form yellow, magenta, cyan and black images and arranged side by side along the upper flat portion of the intermediate transfer belt 110 supported by the rollers 14 and 15.

Each of the four image forming units 18 has a photoreceptor drum 1 (1Y, 1M, 1C or 1K) contacted with the intermediate transfer belt 110, and a charger 2, a developing device 4 (4Y, 4M, 4C and 4K), a cleaner 7, a discharger (not shown), etc., are provided around the photoreceptor drum. In addition, primary transfer members 62 (62Y, 62M, 62C and 62K) are provided so as to face the photoreceptor drums 1 with the intermediate transfer belt 110 therebetween. In this embodiment of the image forming apparatus, the four image forming units 18 have the same configuration, but the color of the toner used for the developer of the developing device is different so that the image forming units produce different color images (i.e., yellow, magenta, cyan and black color images). In addition, an irradiating device 21 is provided above the image forming units 18 to irradiate the surface of each of the photoreceptor drums 1 with a laser beam (illustrated by a chain line) modulated by image information through a space between the charger 2 and the developing device 4. In this regard, four irradiating devices may be provided for the respective image forming units 18, but it is preferable to use a single irradiating device for the four image forming units to reduce the cost of the irradiating device 21.

Figure 2:
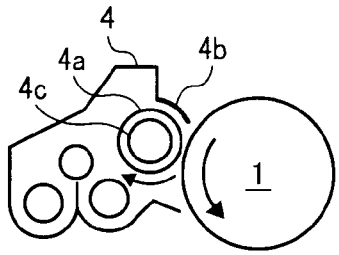
FIG. 2 is a schematic view illustrating an example of the developing device of the present invention.

The developing devices 4Y, 4M, 4C and 4K have substantially the same configuration except that the color of the toner included in the developer is different, i.e., yellow, magenta, cyan and black toners are used for the developing devices 4Y, 4M, 4C and 4K, respectively. As illustrated in FIG. 2, each developing device 4 includes a developing sleeve 4*a*, which has a fixed magnetic field generator 4*c* therein and which rotates while bearing the developer thereon, and a developer layer forming member 4*b* configured to form a developer layer on the developing sleeve to develop an electrostatic latent image on the photoreceptor drum 1 with the developer, resulting in formation of a toner image on the photoreceptor drum.

A secondary transfer device 22 is provided on the opposite side of the tandem image forming section 20 relative to the intermediate transfer belt 110. The secondary transfer device 22 includes an endless secondary transfer belt 24, which is tightly stretched across two rollers 23 and 23 and which is pressed toward the roller 16 so as to be contacted with the roller with the intermediate transfer belt 110 therebetween.

Further, a fixing device 25 configured to fix a toner image formed on a recording sheet is provided on the left side of the secondary transfer device 22. The fixing device 25 has a pressing roller 27, and an endless fixing belt 26 supported by two rollers so as to be pressed toward the pressing roller.

The secondary transfer device 22 also has a function of feeding a recording sheet (such as a paper sheet or a film sheet) bearing a toner image thereon to the fixing device 25. A non-contact charger may be used as the secondary transfer device 22 instead of such an endless belt. In such a case, it is necessary for the secondary transfer device to have a sheet feeding member configured to feed a recording sheet to the fixing device 25.

Further, a sheet reversing device 28 is provided below the secondary transfer device 22 and the fixing device 25 so as to be parallel to the tandem image forming section 20 to reverse a recording sheet bearing a fixed toner image on one side thereof and to produce a duplex copy.

Next, a full color image forming operation of the tandem color image forming apparatus will be described by reference to FIG. 1.

An original to be copied is set on a table 30 of the automatic document feeder 400. Alternatively, the original may be directly set on a glass plate 32 of the scanner 300 after the automatic document feeder 400 is opened, followed by closing the automatic document feeder to press the original toward the glass plate.

When a start button (not shown) is pushed, the color image of the original set on the glass plate 32 is scanned with a first traveler 33 and a second traveler 34, which move in the right direction in FIG. 1, to be read. In the case in which the original is set on the table 30 of the automatic document feeder 400, the original is initially fed toward the glass plate 32, and then the color image thereon is scanned with the first and second travelers 33 and 34 to be read. The first traveler 33 irradiates the color image on the original with light and the second traveler 34 reflects the light reflected from the color image to send the color light image to a sensor 36 via a focusing lens 35. Thus, color image information (i.e., black, yellow, magenta and cyan color image data) of the original is obtained.

Meanwhile, the intermediate transfer belt 110 starts to rotate and the photoreceptor drums 1 also start to rotate. The irradiating device 21 irradiates the photoreceptors 1, each of which has been charged by the charger 2, with laser beams modulated so as to respectively include the yellow, magenta, cyan and black color image data of the original image to form electrostatic latent images corresponding to the yellow, magenta, cyan and black color images on the respective photoreceptor drums. The developing devices 4 develop the respective electrostatic latent images with developers including yellow, magenta, cyan and black toners to form yellow, magenta, cyan and black toner images on the respective photoreceptor drums 1. The thus-formed yellow, magenta, cyan and black toner images are sequentially transferred onto the intermediate transfer belt 110, resulting in formation of a combined multiple color toner image on the intermediate transfer belt.

Meanwhile, one of sheet feeding rollers 42 of the sheet feeding section 200 is selectively rotated to feed a recording sheet from one of multiple sheet cassettes 44, which are arranged in a sheet bank 43 so as to be overlaid, toward a feeding roller 45 and a feeding passage 46. The recording sheet is then fed to a passage 48 by multiple feeding rollers 47, and is stopped by a pair of registration rollers 49 when the tip of the sheet strikes the registration rollers.

When manual sheet feeding is selected, a sheet feeding roller 50 is rotated to feed a recording sheet from a manual sheet tray 51 to a separation roller 52 so that the recording sheet is fed to the pair of registration rollers 49 along a guide 53 while separated from other sheets on the manual sheet tray.

Next, the pair of registration rollers 49 is timely rotated to feed the recording sheet to a nip formed by the intermediate transfer belt 110 and the secondary transfer device 22 so that the combined color toner image on the intermediate transfer belt is transferred onto a proper position of the recording sheet at the nip.

The recording sheet bearing the combined color toner image thereon is then fed to the fixing device 25 by the secondary transfer device 22 so that the combined color toner image is fixed on the recording sheet upon application of heat and pressure, resulting in formation of a full color image on the recording sheet. The recording sheet bearing a fixed full color image thereon is then discharged from the main body 100 by a discharge roller 56 while the sheet path is properly selected by a paper path changing pick 105, resulting in stacking of a copy on a copy tray 57. When a duplex copy is produced, the paper path changing pick 105 is switched so that the recording sheet bearing a fixed image on one side thereof is fed to the sheet reversing device 28 to be reversed. The thus-reversed recording sheet is then fed to the second transfer device 22 through the passage 48 so that a second combined color toner image formed on the intermediate transfer belt 110 is transferred to the other side of the recording sheet by the secondary transfer device. The second combined color toner image formed on the other side is also fixed by the fixing device 25 and the duplex copy is then discharged to the copy tray 57 by the discharge roller 56.

After a secondary image transfer operation, the surface of the intermediate transfer device 110 is cleaned by an intermediate transfer belt cleaner 90 to remove residual toner remaining thereon so that the intermediate transfer belt is ready for the next secondary transfer operation.

Next, the process cartridge of the present invention will be described by reference to FIG. 3.

The process cartridge of the present invention includes at least an image bearing member configured to bear an electrostatic latent image, and a developing device configured to develop the electrostatic latent image on the image bearing member with the developer of the present invention to form a toner image on the image bearing member, wherein the image bearing member and the developing device are integrated into a single unit.

Figure 3:
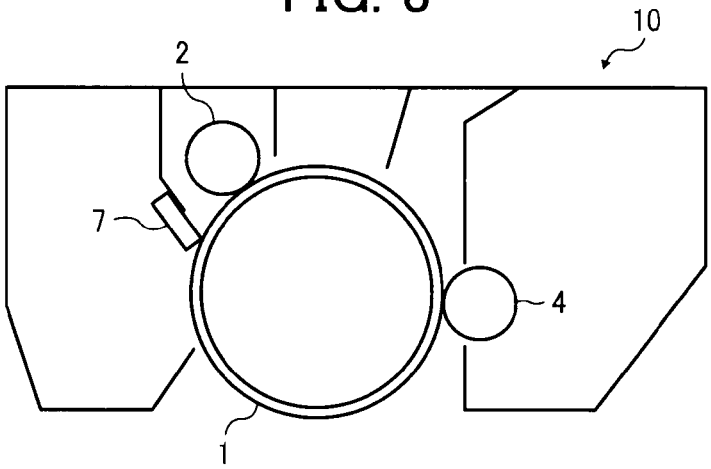
FIG. 3 is a schematic view illustrating an example of the process cartridge of the present invention.

FIG. 3 illustrates an example of the process cartridge of the present invention. Referring to FIG. 3, a process cartridge 10 includes the photoreceptor 1 serving as an image bearing member, the charger 2 configured to charge the photoreceptor, the developing device 4 configured to develop an electrostatic latent image, which is formed on the photoreceptor by irradiating the charged photoreceptor with light emitted from a light irradiating device, with the developer of the present invention to form a toner image on the photoreceptor, and the cleaner 7 configured to clean the surface of the photoreceptor after the toner image is transferred onto a recording material. These devices are integrated, and the process cartridge can be detachably attachable to an image forming apparatus such as copiers, printers and facsimile machines.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Preparation of Coated Carrier)

1. Preparation of Cover Layer Coating Liquid

The following components were mixed.

| | |
|---|---|
| Silicone resin solution (solid content of 23% by weight, SR2410 from Dow Corning Toray Silicone Co., Ltd.) | 432.2 parts |
| Amino silane (solid content of 100%, SH6020 from Dow Corning Toray Silicone Co., Ltd.) | 0.66 parts |
| Barium sulfate covered with oxygen-deficient tin oxide (particulate material 1) (PASTRAN 4310 from Mitsui Mining & Smelting Co., Ltd.) | 500 parts |
| Toluene | 900 parts |

The mixture was subjected to a dispersing treatment for 1 hour using 1,000 parts of zirconia beads with a diameter of 0.5 mm and a paint shaker. After the dispersing treatment, the zirconia beads were removed therefrom using a screen to prepare a cover layer coating liquid. The average particle diameter of the particulate material 1 in the coating liquid was measured with an instrument LA-950V2 from Horiba Ltd. As a result, the particulate material 1 had an average particle diameter of 0.3 μm in the coating liquid.

2. Preparation of Coated Carrier

Initially, 5,000 parts of a calcined ferrite powder having a true specific gravity of 5.5 was coated with the above-prepared cover layer coating liquid while dried using a coater, SPIRA COTA from Okada Seiko Co., Ltd. In this regard, the temperature in the coater was controlled at 50° C. The thickness of the resinous portion of the cover layer was 0.35 μm.

The thus-coated carrier was then aged for 1 hour in an electric furnace heated to 200° C. After being cooled, the coated carrier was sieved using a screen having openings of 63 μm so as to be dissociated. Thus, a carrier 1 was prepared. The volume average particle diameter of the carrier 1 was 35 μm.

The volume average particle diameter of the carrier was determined using a particle analyzer, MICROTRACK SRA from Nikki so Co., Ltd. The measuring conditions were as follows.

Particle diameter range: 0.7 μm to 125 μm

Dispersing medium used: methanol

Refractive index of dispersing medium: set to 1.33

Refractive index of carrier (or core material): set to 2.42

The thickness of the resinous portion of the cover layer was determined by the method mentioned above.

The magnetization intensity of the carrier was measured with an instrument VSM-P7-15 from Toei Industry Co., Ltd. Specifically, about 0.15 g of a carrier was fed into a cell having an inner diameter of 2.4 mm and a height of 8.5 mm, and the magnetization intensity of the carrier was measured by the instrument at a magnetic field of 1 kOe.

(Preparation of Toner)

1. Preparation of Binder Resin

The following components were fed into a reaction vessel equipped with a thermometer, an agitator, a condenser and a nitrogen feed pipe to be mixed.

| | |
|---|---|
| Ethylene oxide (2 mole) adduct of bisphenol A | 724 parts |
| Isophthalic acid | 276 parts |
| Dibutyltin oxide | 2 parts |

The mixture was heated to 230° C. and the temperature was maintained for 8 hours to react the components at a normal pressure.

The reaction was further performed for 5 hours under a reduced pressure of from 10 to 15 mmHg (1.33 to 2.00 Pa). After being cooled to 160° C., the reaction product was mixed with 32 parts of phthalic anhydride, and the mixture was reacted for 2 hours at the temperature.

After being cooled to 80° C., the reaction product was reacted with 188 parts of isophorone diisocyanate for 2 hours in ethyl acetate. Thus, an isocyanate-containing prepolymer (1) was prepared.

Next, 267 parts of the prepolymer (1) was reacted with 14 parts of isophorone diamine for 2 hours at 50° C. Thus, a urea-modified polyester (1), which has a weight average molecular weight of 64,000, was prepared.

Similarly to the method mentioned above for use in preparing the prepolymer (1), the following components were mixed and reacted for 8 hours at 230° C., followed by a further reaction for 5 hours at a reduced pressure of from 10 to 15 mmHg (1.33 to 2.00 Pa).

| | |
|---|---|
| Ethylene oxide (2 mole) adduct of bisphenol A | 724 parts |
| Terephthalic acid | 276 parts |

Thus, an unmodified polyester resin (a) having a peak molecular weight of 5,000 was prepared.

Next, the following components were mixed to prepare a binder resin solution.

| | |
|---|---|
| Urea-modified polyester (1) | 200 parts |
| Unmodified polyester (a) | 800 parts |
| Ethyl acetate | 1000 parts |
| Methyl ethyl ketone | 1000 parts |

Part of the binder resin solution was dried at a reduced pressure to obtain a solid toner binder (1). The toner binder (1) had a glass transition temperature of 62° C.

2. Preparation of Toner

The following components were fed into a beaker.

| | |
|---|---|
| The binder resin solution prepared above | 240 parts |
| Pentaerythritol tetrabehenate (melting point of 81° C., and melt viscosity of 25 cps (i.e., 25 mPa · s) | 20 parts |
| C.I. Pigment Yellow 154 | 4 parts |

The mixture was agitated at 60° C. using a TK HOMOMIXER mixer (from Tokushu Kika Kogyo Co., Ltd.) rotated at a revolution of 12,000 rpm so that the components were evenly dissolved or dispersed. Thus, a toner component liquid was prepared.

On the other hand, the following components were mixed in a beaker to prepare an aqueous phase liquid.

| | |
|---|---|
| Ion-exchange water | 706 parts |
| 10% suspension of hydroxyapatite (SUPERTITE 10 from Nippon Chemical Industrial Co., Ltd.) | 294 parts |
| Sodium dodecylbenzenesulfonate | 0.2 parts |

After the aqueous phase liquid was heated to 60° C., the above-prepared toner component liquid was fed into the aqueous phase liquid, and the mixture was agitated for 10 minutes by the TK HOMOMIXER mixer rotated at a revolution of 12,000 rpm.

After the mixture was fed into a flask equipped with an agitator and a thermometer, the mixture was heated to 98° C. to remove the solvents therefrom to prepare a dispersion slurry, followed by filtering. Thus, a wet cake was prepared.

The thus prepared wet cake was mixed with 100 parts of ion-exchange water, and the mixture was agitated for 10 minutes with a TK HOMOMIXER rotated at a revolution of 12,000 rpm, followed by filtering at a reduced pressure. Thus, a wet cake (a) was prepared.

The thus prepared wet cake (a) was mixed with 100 parts of a 10 wt % solution of sodium hydroxide, and the mixture was agitated for 10 minutes with the TK HOMOMIXER mixer rotated at a revolution of 12,000 rpm, followed by filtering. Thus, a wet cake (b) was prepared.

The thus prepared wet cake (b) was mixed with 100 parts of a 10 wt % solution of hydrochloric acid, and the mixture was agitated for 10 minutes with the TK HOMOMIXER mixer rotated at a revolution of 12,000 rpm, followed by filtering. Thus, a wet cake (c) was prepared.

The thus prepared wet cake (c) was mixed with 300 parts of ion-exchange water, and the mixture was agitated for 10 minutes with the TK HOMOMIXER rotated at a revolution of 12,000 rpm, followed by filtering. This washing operation was performed twice in total. Thus, a final wet cake (1) was prepared.

The thus prepared final wet cake (1) was dried for 48 hours at 45° C. using a circulating air drier, followed by sieving with a screen having openings of 75 μm.

Thus, yellow toner particles (i.e., yellow mother toner) (1) were prepared.

One hundred (100) parts of the yellow toner particles (1) were mixed with 1.5 parts of a hydrophobized silica, and 0.7 parts of a hydrophobized titanium oxide, and the mixture was subjected to a mixing treatment using a HENSCHEL MIXER mixer under the following conditions.

Revolution: 2,000 rpm

Treatment time: 30 seconds/cycle

Number of treatment repeated: 5 times (5 cycles)

Thus, a yellow toner 1 was prepared.

(Preparation of Developer)

The following components were mixed and agitated.

| | |
|---|---|
| Yellow toner 1 prepared above | 7 parts |
| Carrier 1 prepared above | 93 parts |

Thus, a developer 1 was prepared.

Example 2

The procedure for preparation of the carrier 1 in Example 1 was repeated except that the added amount of the barium sulfate covered with oxygen-deficient tin oxide (i.e., particulate material 1) was changed from 500 parts to 250 parts, to prepare a carrier 2. In this regard, the particulate material 1 had an average particle diameter of 0.3 μm in the cover layer coating liquid.

Next, the following components were mixed and agitated.

| | |
|---|---|
| Yellow toner 1 prepared above | 7 parts |
| Carrier 2 prepared above | 93 parts |

Thus, a developer 2 was prepared.

Example 3

The procedure for preparation of the carrier 1 in Example 1 was repeated except that the added amount of the barium sulfate covered with oxygen-deficient tin oxide (i.e., particulate material 1) was changed from 500 parts to 350 parts, to prepare a carrier 3. In this regard, the particulate material 1 had an average particle diameter of 0.3 μm in the cover layer coating liquid.

Next, the following components were mixed and agitated.

| | |
|---|---|
| Yellow toner 1 prepared above | 7 parts |
| Carrier 3 prepared above | 93 parts |

Thus, a developer 3 was prepared.

Example 4

(Preparation of Coated Carrier)

(Preparation of Cover Layer Coating Liquid)

The following components were mixed.

| | |
|---|---|
| Silicone resin solution (solid content of 23% by weight, SR2410 from Dow Corning Toray Silicone Co., Ltd.) | 432.2 parts |
| Amino silane (solid content of 100%, SH6020 from Dow Corning Toray Silicone Co., Ltd.) | 0.66 parts |

-continued

| | |
|---|---|
| Barium sulfate covered with oxygen-deficient tin oxide (particulate material 1) (PASTRAN 4310 from Mitsui Mining & Smelting Co., Ltd.) | 500 parts |
| Toluene | 900 parts |

The mixture was subjected to a dispersing treatment for 1 hour using 1,000 parts of zirconia beads with a diameter of 0.5 mm and a paint shaker. After the dispersing treatment, the zirconia beads were removed therefrom using a screen to prepare a cover layer coating liquid. The particulate material 1 in the coating liquid had an average particle diameter of 0.3 μm.

2. Preparation of Coated Carrier

Initially, 5,000 parts of a calcined ferrite powder having an average particle diameter of 25 μm and a true specific gravity of 5.5 was coated with the above-prepared cover layer coating liquid while dried using the coater, SPIRA COTA from Okada Seiko Co., Ltd. In this regard, the temperature in the coater was controlled at 50° C. The thickness of the resinous portion of the cover layer was 0.35 μm.

The thus-coated carrier was then aged for 1 hour in an electric furnace heated to 200° C. After being cooled, the coated carrier was sieved using a screen having openings of 63 μm so as to be dissociated. Thus, a carrier 4 was prepared.

Next, the following components were mixed and agitated.

| | |
|---|---|
| Yellow toner 1 prepared above | 7 parts |
| Carrier 4 prepared above | 93 parts |

Thus, a developer 4 was prepared.

Example 5

(Preparation of Coated Carrier)

1. Preparation of Cover Layer Coating Liquid

The following components were mixed.

| | |
|---|---|
| Acrylic resin solution (solid content of 50% by weight, SR2410 from Dow Corning Toray Silicone Co., Ltd.) | 39.7 parts |
| Guanamine solution (solid content of 70%) | 12.4 parts |
| Acid catalyst (solid content of 40%) | 0.22 parts |
| Silicone resin solution (solid content of 23% by weight, SR2410 from Dow Corning Toray Silicone Co., Ltd.) | 185.8 parts |
| Amino silane (solid content of 100%, SH6020 from Dow Corning Toray Silicone Co., Ltd.) | 0.66 parts |
| Barium sulfate covered with oxygen-deficient tin oxide (particulate material 1) (PASTRAN 4310 from Mitsui Mining & Smelting Co., Ltd.) | 500 parts |
| Toluene | 900 parts |

The mixture was subjected to a dispersing treatment for 1 hour using 1,000 parts of zirconia beads with a diameter of 0.5 mm and a paint shaker. After the dispersing treatment, the zirconia beads were removed therefrom using a screen to prepare a cover layer coating liquid. The particulate material 1 in the coating liquid had an average particle diameter of 0.4 μm.

2. Preparation of Coated Carrier

Initially, 5,000 parts of a calcined ferrite powder having an average particle diameter of 35 μm and a true specific gravity of 5.5 was coated with the above-prepared cover layer coating liquid while dried using the coater, SPIRA COTA from Okada Seiko Co., Ltd. In this regard, the temperature in the coater was controlled at 50° C. The thickness of the resinous portion of the cover layer was 0.35 μm.

The thus coated carrier was then aged for 1 hour in the electric furnace heated to 200° C. After being cooled, the coated carrier was sieved using a screen having openings of 63 μm so as to be dissociated. Thus, a carrier 5 was prepared.

Next, the following components were mixed and agitated.

| | |
|---|---|
| Yellow toner 1 prepared above | 7 parts |
| Carrier 5 prepared above | 93 parts |

Thus, a developer 5 was prepared.

Example 6

(Preparation of Coated Carrier)

1. Preparation of Cover Layer Coating Liquid

The following components were mixed.

| | |
|---|---|
| Silicone resin solution (solid content of 23% by weight, SR2410 from Dow Corning Toray Silicone Co., Ltd.) | 432.2 parts |
| Amino silane (solid content of 100%, SH6020 from Dow Corning Toray Silicone Co., Ltd.) | 0.66 parts |
| Barium sulfate covered with oxygen-deficient tin oxide (particulate material 1) (PASTRAN 4310 from Mitsui Mining & Smelting Co., Ltd.) | 250 parts |
| Antimony-free tin oxide powder (particulate material 3, S-1 from Mitsubishi Materials Corp.) | 150 parts |
| Toluene | 900 parts |

The mixture was subjected to a dispersing treatment for 1 hour using 1,000 parts of zirconia beads with a diameter of 0.5 mm and a paint shaker. After the dispersing treatment, the zirconia beads were removed therefrom using a screen to prepare a cover layer coating liquid. The particulate material 1 in the coating liquid had an average particle diameter of 0.5 μm.

2. Preparation of Coated Carrier

Initially, 5,000 parts of a calcined ferrite powder having an average particle diameter of 35 μm and a true specific gravity of 5.5 was coated with the above-prepared cover layer coating liquid while dried using the coater, SPIRA COTA from Okada Seiko Co., Ltd. In this regard, the temperature in the coater was controlled at 50° C. The thickness of the resinous portion of the cover layer was 0.35 μm.

The thus coated carrier was then aged for 1 hour in an electric furnace heated to 200° C. After being cooled, the coated carrier was sieved using a screen having openings of 63 μm so as to be dissociated. Thus, a carrier 6 was prepared.

Next, the following components were mixed and agitated.

| | |
|---|---|
| Yellow toner 1 prepared above | 7 parts |
| Carrier 6 prepared above | 93 parts |

Thus, a developer 6 was prepared.

Example 7

(Preparation of Coated Carrier)

1. Preparation of Cover Layer Coating Liquid

The following components were mixed.

| | |
|---|---|
| Silicone resin solution (solid content of 23% by weight, SR2410 from Dow Corning Toray Silicone Co., Ltd.) | 432.2 parts |
| Amino silane (solid content of 100%, SH6020 from Dow Corning Toray Silicone Co., Ltd.) | 0.66 parts |
| Barium sulfate powder (particulate material 4, BF-10 from Sakai Chemical Industry Co., Ltd.) | 250 parts |
| Antimony-free tin oxide powder (particulate material 3, S-1 from Mitsubishi Materials Corp.) Toluene | 150 parts<br>900 parts |

The mixture was subjected to a dispersing treatment for 1 hour using 1,000 parts of zirconia beads with a diameter of 0.5 mm and a paint shaker. After the dispersing treatment, the zirconia beads were removed therefrom using a screen to prepare a cover layer coating liquid. The particulate materials 3 and 4 in the coating liquid had an average particle diameter of 0.4 μm.

2. Preparation of Coated Carrier

Initially, 5,000 parts of a calcined ferrite powder having an average particle diameter of 35 μm and a true specific gravity of 5.5 was coated with the above-prepared cover layer coating liquid while dried using the coater, SPIRA COTA from Okada Seiko Co., Ltd. In this regard, the temperature in the coater was controlled at 50° C. The thickness of the resinous portion of the cover layer was 0.35 μm.

The thus coated carrier was then aged for 1 hour in an electric furnace heated to 200° C. After being cooled, the coated carrier was sieved using a screen having openings of 63 μm so as to be dissociated. Thus, a carrier 7 was prepared.

Next, the following components were mixed and agitated.

| | |
|---|---|
| Yellow toner 1 prepared above | 7 parts |
| Carrier 7 prepared above | 93 parts |

Thus, a developer 7 was prepared.

Example 8

(Preparation of Coated Carrier)

1. Preparation of Cover Layer Coating Liquid

The following components were mixed.

| | |
|---|---|
| Silicone resin solution (solid content of 23% by weight, SR2410 from Dow Corning Toray Silicone Co., Ltd.) | 432.2 parts |
| Amino silane (solid content of 100%, SH6020 from Dow Corning Toray Silicone Co., Ltd.) | 0.66 parts |
| Barium sulfate powder (particulate material 4, BF-10 from Sakai Chemical IndustryCo., Ltd.) | 250 parts |
| Toluene | 900 parts |

The mixture was subjected to a dispersing treatment for 1 hour using 1,000 parts of zirconia beads with a diameter of 0.5 mm and a paint shaker. After the dispersing treatment, the zirconia beads were removed therefrom using a screen to prepare a cover layer coating liquid. The particulate material 4 in the coating liquid had an average particle diameter of 0.3 μm.

2. Preparation of Coated Carrier

Initially, 5,000 parts of a calcined ferrite powder having an average particle diameter of 35 μm and a true specific gravity of 5.5 was coated with the above-prepared cover layer coating liquid while dried using the coater, SPIRA COTA from Okada Seiko Co., Ltd. In this regard, the temperature in the coater was controlled at 50° C. The thickness of the resinous portion of the cover layer was 0.35 μm.

The thus coated carrier was then aged for 1 hour in an electric furnace heated to 200° C. After being cooled, the coated carrier was sieved using a screen having openings of 63 μm so as to be dissociated. Thus, a carrier 8 was prepared.

Next, the following components were mixed and agitated.

| | |
|---|---|
| Yellow toner 1 prepared above | 7 parts |
| Carrier 8 prepared above | 93 parts |

Thus, a developer 8 was prepared.

Example 9

The procedure for preparation of the carrier 1 in Example 1 was repeated except that the dispersing treatment was performed using a HOMOMIXER mixer instead of the paint shaker, to prepare a carrier 9. In this regard, the particulate material 1 in the cover layer coating liquid had an average particle diameter of 3.3 μm.

Next, the following components were mixed and agitated.

| | |
|---|---|
| Yellow toner 1 prepared above | 7 parts |
| Carrier 9 prepared above | 93 parts |

Thus, a developer 9 was prepared.

Example 10

The procedure for preparation of the carrier 1 in Example 1 was repeated to prepare the carrier 1.

In addition, the procedure for preparation of the developer 1 in Example 1 was repeated to prepare the developer 1.

Next, the following components were mixed and agitated.

| | |
|---|---|
| Yellow toner 1 prepared above | 10 parts |
| Carrier 1 prepared above | 1 part |

Thus, a supplementary developer 1, which was used as a supplementary developer for use in the running test mentioned below, was prepared.

Comparative Example 1

The procedure for preparation of the carrier 1 in Example 1 was repeated except that the particulate material 1 was replaced with 500 parts of a particulate material 2, i.e., a titanium oxide powder coated with an antimony-free tin oxide (EPW-4 from Mitsubishi Materials Corp.), to prepare a carrier 10. In this regard, the particulate material 2 in the cover layer coating liquid had an average particle diameter of 0.7 μm.

Next, the following components were mixed and agitated.

| | |
|---|---|
| Yellow toner 1 prepared above | 7 parts |
| Carrier 10 prepared above | 93 parts |

Thus, a developer 10 was prepared.

Comparative Example 2

The procedure for preparation of the carrier 1 in Example 1 was repeated except that the particulate material 1 was replaced with 250 parts of the particulate material 3 (antimony-free tin oxide powder) to prepare a carrier 11. In this regard, the particulate material 3 in the cover layer coating liquid had an average particle diameter of 0.5 μm.

Next, the following components were mixed and agitated.

| | |
|---|---|
| Yellow toner 1 prepared above | 7 parts |
| Carrier 11 prepared above | 93 parts |

Thus, a developer 11 was prepared.

Comparative Example 3

The procedure for preparation of the carrier in Example 1 was repeated except that the added amount of the particulate material 1 was changed from 500 parts to 600 parts, to prepare a carrier 12. In this regard, the particulate material 1 in the cover layer coating liquid had an average particle diameter of 0.3 μm.

The following components were mixed.

| | |
|---|---|
| Toner 1 prepared above | 7 parts |
| Carrier 12 prepared above | 93 parts |

Thus, a developer 12 was prepared.

Comparative Example 4

The procedure for preparation of the carrier in Example 1 was repeated except that the added amount of the particulate material 1 was changed from 500 parts to 200 parts, to prepare a carrier 13. In this regard, the particulate material 1 in the cover layer coating liquid had an average particle diameter of 0.3 μm.

The following components were mixed.

| | |
|---|---|
| Toner 1 prepared above | 7 parts |
| Carrier 13 prepared above | 93 parts |

Thus, a developer 13 was prepared.

Comparative Example 5

The procedure for preparation of the carrier in Example 1 was repeated except that the particulate material 1 was replaced with 50 parts of a particulate material 5, i.e., a carbon black (PRINTEX 60 from Degussa AG), to prepare a carrier 14. In this regard, the particulate material 5 in the cover layer coating liquid had an average particle diameter of 0.2 μm.

The following components were mixed.

| | |
|---|---|
| Toner 1 prepared above | 7 parts |
| Carrier 14 prepared above | 93 parts |

Thus, a developer 14 was prepared.

The above-prepared carriers and developers were evaluated as follows.

1. Evaluation of carrier (1) Volume Average Particle Diameter of Carrier (Dv)

The above-mentioned method for measuring the volume average particle diameter of a carrier was used.

(2) Logarithmic Volume Resistivity (log R(Ω·cm))

The above-mentioned method for measuring the logarithmic volume resistivity of a carrier was used.

(3) Particle Diameter of Particulate Material Dispersed in the Cover Layer Coating Liquid The average particle diameter of the particulate material dispersed in the cover layer coating liquid was measured with an instrument LA-952V2 from Horiba Ltd.

(4) Ba/Si Ratio

The above-mentioned method for measuring the Ba/Si ratio was used.

(5) Magnetization Intensity

The above-mentioned method for measuring the magnetization intensity was used.

The results are shown in Table 1.

2. Evaluation of Developer (1) Running Test (1)

Each of the developers was set in a color printer (i.e., modified version of IMAGIO NEO C455 from Ricoh Co., Ltd.), and a running test (1) in which 30,000 copies of an original chart having an image area ratio of 20% are continuously produced while the toner (1) is supplied to the developing device to compensate the toner used for development was performed. In this regard, only when the developer of Example 10 was subjected to the running test, the supplementary developer 1 was supplied to the developing device while removing the excess carrier particles from the developing device.

(a) Evaluation of Background Development

After the running test, a white image was produced using the image forming apparatus to determine whether the developer causes background development. Specifically, after an electrostatic latent image corresponding to a white image was developed and before the developed image is transferred to a recording sheet, the image forming apparatus was suddenly stopped, and toner particles present on a surface of the image bearing member (which correspond to a white image portion) were transferred to an adhesive tape. The tape bearing toner particles thereon was attached to a white paper while a blank tape was also attached to the white paper, and the optical density (OD1) of the tape bearing toner images and the optical density (OD0) of the blank tape were measured with a spectrodensitometer 938 from X-Rite Inc. to determine the optical density difference (OD1−OD0).

The background development property of the developer is graded as follows.

◎: The optical density difference (OD1−OD0) is less than 0.005. (excellent)

○: The optical density difference (OD1−OD0) is not less than 0.005 and less than 0.01. (good)

Δ: The optical density difference (OD1−OD0) is not less than 0.01 and less than 0.02. (acceptable)

X: The optical density difference (OD1−OD0) is greater than 0.02. (unusable)

(b) Evaluation of Toner Scattering

After the running test, the developing roller and the members in the vicinity of the developing roller in the image forming apparatus were visually observed to determine whether the developing roller and members are contaminated by scattered toner particles.

The toner scattering property of the developer is graded as follows.

◎: Toner scattering is not caused. (excellent)

○: Toner scattering is slightly caused. (good)

Δ: Toner scattering is caused, but is still on an acceptable level. (acceptable)

X: Toner scattering is seriously caused. (unusable)

(c) Evaluation of Charge Quantity Variation

After the running test, the charge quantity of the cattier was measured to determine the amount of decrease in charge quantity before and after the running test.

The method for measuring the charge quantity is as follows.

A carrier, which was not used, was aged for 30 minutes or more under environmental conditions of 23.5° C. and 60% RH. Next, 6.00 g of the aged carrier and 0.452 g of the toner (1) were contained in an airtight stainless steel container, and the container was shaken for 5 minutes using a shaking machine YS-LD from Yayoi Co., Ltd., whose shake-period dial is set to 150 (i.e., shaking is performed about 1,100 times). The thus-shaken developer was subjected to a blow-off treatment using an instrument (TB-20 from Toshiba Chemical Corp.) to determine the charge quantity (Q1) of the carrier. Next, the developer used for the running test was subjected to the blow-off treatment to obtain the carrier used for the running test. The charge quantity (Q2) of the used carrier was measured by the method mentioned above to determine the charge quantity difference (Q1−Q2).

The charge quantity difference (Q1−Q2) was preferably from −10.0 μC/g to 10.0 μC/g.

The results of the running test (1) are shown in Table 2-1.

(2) Running Test (2)

Each of the developers was set in the color printer mentioned above, and a running test (2) in which 30,000 copies of an original chart having an image area ratio of 50% are continuously produced while the toner (1) is supplied to the developing device to compensate the toner used for development was performed. In this regard, only when the developer of Example 10 was subjected to the running test, the supplementary developer 1 was supplied to the developing device while removing the excess carrier particles from the developing device.

Similarly to the evaluation in the running test (1), the background development, toner scattering and charge quantity variation of each developer were evaluated after the running test (2).

The results of the running test (2) are shown in Table 2-2.

(3) Running Test (3)

Each of the developers was set in the color printer mentioned above, and a running test (3) in which 30,000 copies of an original chart having an image area ratio of 0.5% are continuously produced while the toner (1) is supplied to the developing device to compensate the toner used for development was performed. In this regard, only when the developer of Example 10 was subjected to the running test, the supplementary developer 1 was supplied to the developing device while removing the excess carrier particles from the developing device.

(a) Evaluation of Carrier Adhesion

After the running test (3), a solid image was repeatedly formed without supplying the supplementary toner or developer to the developing device so that the concentration of the toner in the developer becomes 4% by weight.

Next, a solid image was formed on an A-4 size recording paper TYPE 6000 from Ricoh Co., Ltd. under conditions of 2 μA in transfer current and 500V in development potential, and the output image was visually observed to determine the number of white spots formed in the solid image, which are caused by adhesion of carrier particles to the image bearing member. The carrier adhesion property is graded as follows.

◎: The number of white spots is less than 50. (excellent)

○: The number of white spots is not less than 50 and less than 200. (good)

Δ: The number of white spots is not less than 200 and less than 400. (acceptable)

X: The number of white spots is not less than 400. (unusable)

(b) Evaluation of Change of Color Tone of Image (Color Mixture)

Before and after the running test (3), a half tone image was formed on a recording paper TYPE 6000 from Ricoh Co., Ltd., and the color tone of the half tone image was measured using an L*a*b* color system to determine ΔE, which is defined as follows.

$$\Delta E=[(L^*1-L^*2)^2+(a^*1-a^*2)^2+(b^*1-b^*2)^2]^{1/2}$$

wherein L1*, a1* and b1* represent the lightness and color tones of the half tone image before the running test, and L2*, a2*, and b2* represent the lightness and color tones of the half tone image after the running test.

The color mixture property of the developers is graded as follows.

◎: ΔE is not less than 0 and less than 2. (excellent)

○: ΔE is not less than 2 and less than 3. (good)

Δ: ΔE is not less than 3 and less than 5. (acceptable)

X: ΔE is not less than 5. (unusable)

(c) Evaluation of Image Density

After the running test (3), a solid image was formed on a recording paper TYPE 6000 from Ricoh Co., Ltd., and the image density of the image was measured with a densitometer X-RITE from X-Rite Inc. The image density property of the developers is graded as follows.

◎: Image density is not lower than 1.8. (excellent)

○: Image density is not lower than 1.4 and lower than 1.8. (good)

Δ: Image density is not lower than 1.2 and lower than 1.4. (acceptable)

X: Image density is lower than 1.2. (unusable)

The results of the running test (3) are shown in Table 2-3.

TABLE 1

| | Carrier | Dv of carrier (μm) | Volume resisivity (log Ω · cm) | Particle diameter of dispersed particulate material (μm) | Ba/Si ratio | Magnet-ization |
|---|---|---|---|---|---|---|
| Ex. 1 | 1 | 35 | 12.1 | 0.3 | 0.078 | 68 |
| Ex. 2 | 2 | 35 | 13.8 | 0.3 | 0.012 | 71 |
| Ex. 3 | 3 | 35 | 13.1 | 0.3 | 0.031 | 70 |
| Ex. 4 | 4 | 25 | 13.4 | 0.3 | 0.072 | 70 |
| Ex. 5 | 5 | 35 | 11.9 | 0.4 | 0.075 | 69 |
| Ex. 6 | 6 | 35 | 11.5 | 0.5 | 0.026 | 67 |
| Ex. 7 | 7 | 35 | 13.5 | 0.4 | 0.053 | 68 |
| Ex. 8 | 8 | 35 | 15.1 | 0.3 | 0.059 | 70 |
| Ex. 9 | 9 | 35 | 11.3 | 3.3 | 0.071 | 69 |

TABLE 1-continued

| | Carrier | Dv of carrier (μm) | Volume resisivity (log Ω · cm) | Particle diameter of dispersed particulate material (μm) | Ba/Si ratio | Magnet-ization |
|---|---|---|---|---|---|---|
| Ex. 10 | 1 | 35 | 12.1 | 0.3 | 0.078 | 68 |
| Comp. Ex. 1 | 10 | 35 | 11.9 | 0.7 | 0.0 | 68 |
| Comp. Ex. 2 | 11 | 35 | 11.5 | 0.5 | 0.0 | 67 |
| Comp. Ex. 3 | 12 | 35 | 11.6 | 0.3 | 0.087 | 66 |
| Comp. Ex. 4 | 13 | 35 | 14.2 | 0.3 | 0.008 | 71 |
| Comp. Ex. 5 | 14 | 35 | 13.2 | 0.2 | 0.0 | 71 |

TABLE 2-1

| | charge quantity variation (μC/g) | Toner scattering | Background development |
|---|---|---|---|
| Ex. 1 | 3 | ◎ | ◎ |
| Ex. 2 | 7 | ○ | ○ |
| Ex. 3 | 4 | ◎ | ◎ |
| Ex. 4 | 5 | ◎ | ◎ |
| Ex. 5 | 2 | ◎ | ◎ |
| Ex. 6 | 6 | ◎ | ○ |
| Ex. 7 | 4 | ◎ | ◎ |
| Ex. 8 | 3 | ◎ | ◎ |
| Ex. 9 | 4 | ○ | ◎ |
| Ex. 10 | 2 | ◎ | ◎ |
| Comp. Ex. 1 | 13 | Δ | ○ |
| Comp. Ex. 2 | 17 | X | Δ |
| Comp. Ex. 3 | 1 | ◎ | ◎ |
| Comp. Ex. 4 | 9 | X | ○ |
| Comp. Ex. 5 | 14 | Δ | Δ |

TABLE 2-2

| | charge quantity variation (μC/g) | Toner scattering | Background development |
|---|---|---|---|
| Ex. 1 | 5 | ◎ | ○ |
| Ex. 2 | 10 | Δ | ○ |
| Ex. 3 | 7 | ○ | ○ |
| Ex. 4 | 6 | ○ | ◎ |
| Ex. 5 | 7 | ○ | ○ |
| Ex. 6 | 9 | ○ | Δ |
| Ex. 7 | 6 | ○ | ○ |
| Ex. 8 | 4 | ◎ | ○ |
| Ex. 9 | 8 | ○ | ○ |
| Ex. 10 | 3 | ◎ | ◎ |
| Comp. Ex. 1 | 23 | X | X |
| Comp. Ex. 2 | 26 | X | X |
| Comp. Ex. 3 | 3 | ◎ | ◎ |
| Comp. Ex. 4 | 13 | X | Δ |
| Comp. Ex. 5 | 22 | X | Δ |

TABLE 2-3

| | Carrier adhesion | Color mixture | Image density |
|---|---|---|---|
| Ex. 1 | ○ | ○ | ○ |
| Ex. 2 | ○ | ○ | ○ |
| Ex. 3 | ○ | ○ | ○ |
| Ex. 4 | Δ | ○ | ○ |
| Ex. 5 | ○ | ○ | ○ |
| Ex. 6 | Δ | ○ | ○ |
| Ex. 7 | ○ | ○ | ○ |
| Ex. 8 | ○ | ○ | Δ |
| Ex. 9 | Δ | ○ | ○ |
| Ex. 10 | ○ | ○ | ○ |
| Comp. Ex. 1 | Δ | Δ | ○ |
| Comp. Ex. 2 | Δ | ○ | Δ |
| Comp. Ex. 3 | ○ | ○ | X |
| Comp. Ex. 4 | X | ○ | ○ |
| Comp. Ex. 5 | Δ | X | ○ |

It is clear from Tables that the developers of the present invention can reliably produce high quality images for a long period of time without causing the problems such as toner scattering, background development and carrier adhesion. Particularly, by using an image forming method of Example 10 in which images are formed while supplying a supplementary developer including the carrier of the present invention and a toner to the developing device, high quality images can be produced for a long period of time.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2010-005096, filed on Jan. 13, 2010, the entire contents of which are herein incorporated by reference.

What is claimed is:

1. A carrier for use in a two component developer for developing an electrostatic latent image, comprising:

a particulate core material; and a cover layer located on a surface of the core material and including a silicone resin and barium sulfate, wherein the cover layer includes Ba and Si at an atomic ratio of from 0.01 to 0.08 as determined by X-ray photoelectron spectroscopy.

2. The carrier according to claim 1, wherein the cover layer further includes tin oxide.

3. The carrier according to claim 1, wherein the carrier has a logarithmic volume resistivity of from 10 log(Ω·cm) to 15 log(Ω·cm).

4. The carrier according to claim 1, wherein the carrier has a volume average particle diameter of from 15 μm to 40 μm.

5. A two component developer for developing an electrostatic latent image, comprising:

the carrier according to claim 1; and a toner including at least a binder resin and a colorant.

6. The two component developer according to claim 5, used as a supplementary developer, wherein a weight ratio (C/T) of the carrier (C) to the toner (T) is from ½ to 1/30.

7. An image forming method comprising:

forming an electrostatic latent image on an image bearing member;

developing the electrostatic latent image with the two component developer according to claim 5 to form a toner image on the image bearing member;

transferring the toner image to a recording material; and fixing the toner image to the recording material.

* * * * *